US012807364B2

(12) United States Patent
Lecointe et al.

(10) Patent No.: US 12,807,364 B2
(45) Date of Patent: Nov. 24, 2026

(54) BLANK CUT FOR PACKAGING A FOOD PORTION AND METHOD FOR PACKAGING A FOOD PORTION

(71) Applicant: BEL, Suresnes (FR)

(72) Inventors: Camille Lecointe, Suresnes (FR); Gilles Coupard, Suresnes (FR)

( * ) Notice: Subject to any disclaimer, the term of this patent is extended or adjusted under 35 U.S.C. 154(b) by 0 days.

(21) Appl. No.: 18/835,029

(22) PCT Filed: Jan. 31, 2023

(86) PCT No.: PCT/EP2023/052316
§ 371 (c)(1),
(2) Date: Aug. 1, 2024

(87) PCT Pub. No.: WO2023/148163
PCT Pub. Date: Aug. 10, 2023

(65) Prior Publication Data

US 2025/0162758 A1 May 22, 2025

(30) Foreign Application Priority Data

Feb. 1, 2022 (FR) ..... 2200897

(51) Int. Cl.
*B65D 5/20* (2006.01)
*B65B 5/02* (2006.01)
(Continued)

(52) U.S. Cl.
CPC ..... *B65D 5/2076* (2013.01); *B65B 5/024* (2013.01); *B65B 5/04* (2013.01); *B65B 25/001* (2013.01);
(Continued)

(58) Field of Classification Search
CPC .... B65D 5/2076; B65D 5/4266; B65D 5/701; B65D 5/545; B65D 75/5833;
(Continued)

(56) References Cited

U.S. PATENT DOCUMENTS 4,738,365 A * 4/1988 Prater ..... B65D 5/545 229/125.32
4,826,011 A † 5/1989 Jud
(Continued)

FOREIGN PATENT DOCUMENTS

FR 1448692 † 6/1966
FR 2808782 A1 † 11/2001
(Continued)

*Primary Examiner* — Christopher R Demeree
(74) *Attorney, Agent, or Firm* — PatShegen IP; Moshe Pinchas

(57) ABSTRACT

The invention relates a blank cut for packaging a food portion (3), comprising fold lines (1*a*, 1*b*, 1*c*) defining an upper panel (5) and a lower panel (6), said lower panel being extended by a side panel (7) extended by an opening tab opposite to the lower panel (6), said tab having a base (8*a*) designed to be associated with a closure seam (9) extending from the upper panel (5), two tear lines (10) each extending, from an edge of the base (8*a*), along the first side panel (7) and the lower panel (6), the seam (9) having no tear line and being arranged so as to be permanently associated on a region of the upper panel (5), the base (8*a*) being arranged so as to be associated on said seam such that it can be peeled off by pulling the opening tab (8).

16 Claims, 9 Drawing Sheets

Figure 1A:
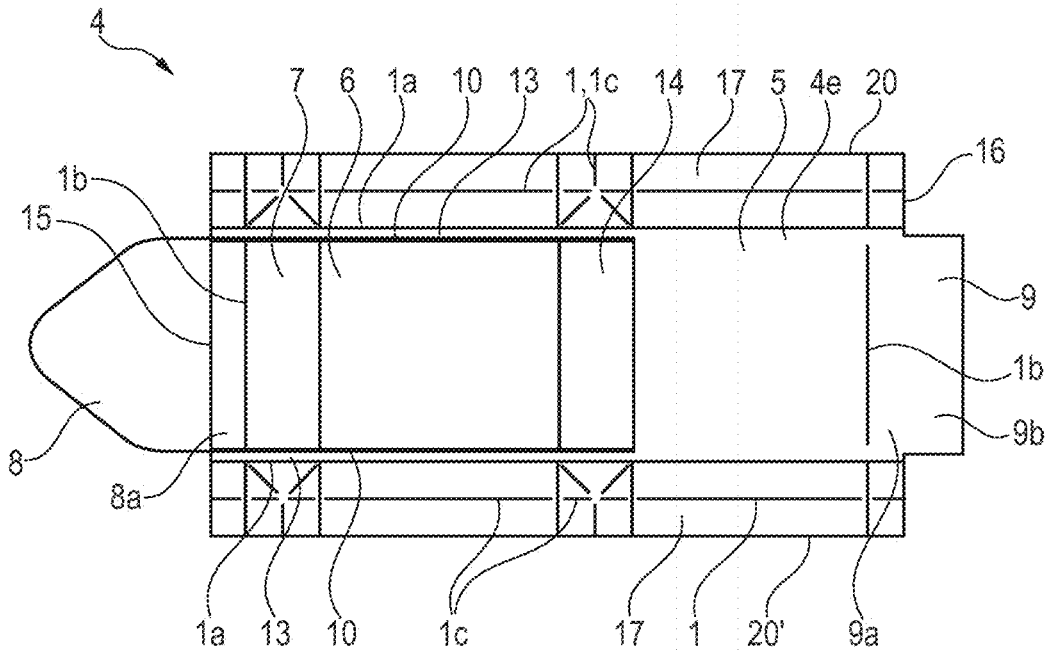

(51) Int. Cl.

| | |
|---|---|
| ***B65B 5/04*** | (2006.01) |
| ***B65B 25/00*** | (2006.01) |
| ***B65D 5/42*** | (2006.01) |
| ***B65D 5/70*** | (2006.01) |

(52) U.S. Cl.
CPC ..... *B65D 5/2028* (2013.01); *B65D 5/4266* (2013.01); *B65D 5/701* (2013.01)

(58) Field of Classification Search
CPC ..... B65D 75/5855; B65D 85/76; B65D 75/5838; B65B 11/48; B65B 9/10
USPC ..... 229/123.3, 125.33, 232, 125.32, 207, 229/87.05; 53/456, 412, 492; 426/122; 493/102; 220/270
See application file for complete search history.

(56) References Cited

U.S. PATENT DOCUMENTS

| | | | | |
|---|---|---|---|---|
| 5,582,342 | A † | 12/1996 | Jud | |
| 2023/0348164 | A1 * | 11/2023 | Vernier | B65D 75/5833 |
| 2025/0153889 | A1 * | 5/2025 | Lecointe | B65D 75/5833 |

FOREIGN PATENT DOCUMENTS

| | | | | |
|---|---|---|---|---|
| FR | 2957062 | A1 * | 9/2011 | B65D 75/5833 |
| FR | 3106341 | † | 7/2021 | |
| WO | 0149586 | A1 † | 7/2021 | |

* cited by examiner
† cited by third party

BLANK CUT FOR PACKAGING A FOOD PORTION AND METHOD FOR PACKAGING A FOOD PORTION

The invention concerns a blank cut for packaging a food portion, as well as a method for packaging a food portion using such a blank cut.

It applies in particular to the packaging of individual food portions of fresh dairy products, such as fresh and/or melted cheese, which are packaged in an open envelope formed by folding a blank cut before closing said envelope.

To guarantee the preservation of the packaged portion, the blank cut must include at least one sealing layer with oxygen and/or water vapor barrier properties, and the package closure must preserve this sealing.

To benefit from an ecologically designed package, notably by facilitating its recycling after consumption of the food portion, the blank cut can be formed from a complex comprising an outer layer based on cellulose fibers and an inner sealing layer.

In particular, in connection with such a blank cut design, the problem arises of the antagonism between the ease of opening the package to be able to consume the portion, especially by young children and/or for soft portions, and the aforementioned sealing constraints which require robust blank cut and closure.

To improve the sealing of the package, document WO-2021/148526 proposes a blank cut comprising fold lines which are arranged to form:

an upper panel and a top panel intended to form respectively upper and lower walls of the envelope, said lower panel being extended by a side panel intended to form a side wall of said envelope;

an opening tab extending from side panel opposite to the lower panel, said tab being intended to be associated with a closure seam extending from the top panel;

the package being closed by longitudinally sealing the tab on the seam along a transverse seal which extends between two longitudinal seals of said package.

To enable such a package to be opened, the blank cut has two tear-guide strips, each extending longitudinally from one edge of the tab to the seam.

For example, document WO-2021/148526 describes a solution in which a pull on the tab allows opening initially by tearing the strips on the tongue/seam association, then by propagation of these tears longitudinally along the entire blank cut.

This solution is not entirely satisfactory in that it requires, particularly in relation to a blank cut comprising a fibrous layer, a high initial effort which may not be compatible with consumption by young children and/or a soft portion.

In addition, the possibility of opening the package along the entire length of the blank cut does not provide the ergonomics expected, particularly in that the unwrapped portion can fall off as it is no longer held by the blank cut.

The invention aims to improve the prior art by proposing in particular a blank cut, in particular of ecological design, which is arranged to form a package for a food portion, said package combining optimum sealing with good opening ergonomics, in particular in relation to ease of opening for young children and/or in relation to a soft portion.

To this end, according to a first aspect, the invention proposes a blank cut for packaging a food portion comprising fold lines allowing the shaping of said blank cut into an envelope in which said portion can be packaged before closing said envelope, said fold lines defining a blank cut having:

an upper panel and a lower panel intended to form respectively upper and lower walls of said envelope, said lower panel being extended by a first side panel intended to form a first side wall of said envelope;

an opening tab extending from said first side panel opposite to the lower panel, said tab having a base designed to be associated with a closure seam extending from the upper panel;

said blank cut further having two tear lines each extending, from an edge of the base of the tab, along the first side panel and the lower panel, the seam having no tear line, said seam being arranged so as to be permanently associated on area region of the upper panel and the base of the tab being arranged so as to be associated on said seam such that it can be peeled off by pulling the opening tab.

According to a second aspect, the invention proposes a method for packaging a food portion by means of such a blank cut, in which said blank cut is folded along its fold lines to form an open envelope in which said portion is packaged before closing said envelope, said method providing for permanently associating the seam on the upper wall of the envelope and peelably associating the base of the tab on said seam.

Further features and advantages of the invention will become apparent from the following description, made with reference to the appended figures, in which:

FIG. 1*a* and

Figure 1B:
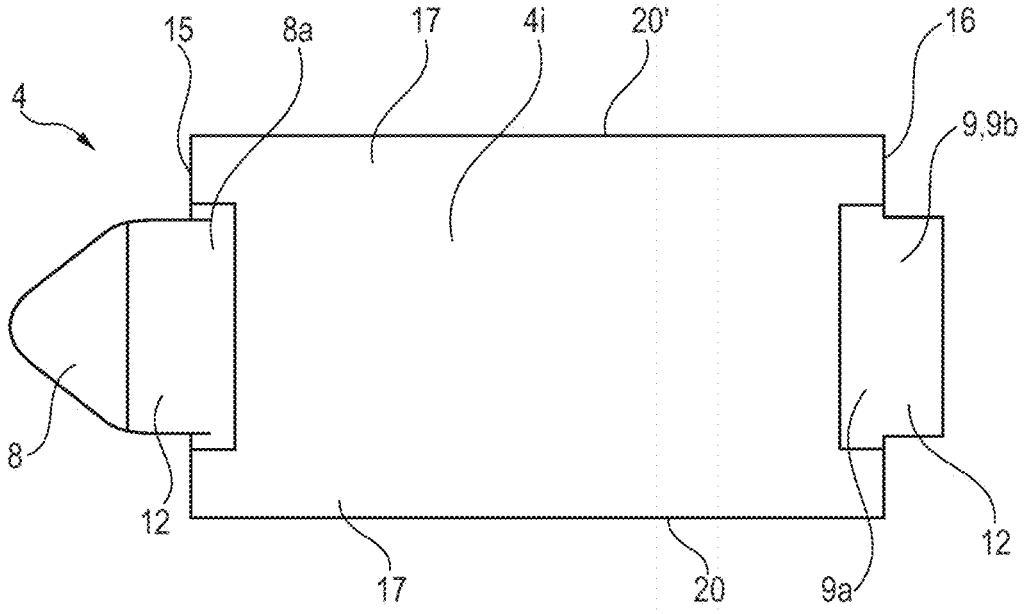

FIG. 1*b* show a schematic front view of a blank cut according to a first embodiment before its folding, seen respectively from the outside (FIG. 1*a*) and from the inside (FIG. 1*b*);

FIG. 2*a*,

FIG. 2*b*,

FIG. 2*c*,

FIG. 2*d*,

FIG. 2*e*,

FIG. 2*f* to

Figure 2A:
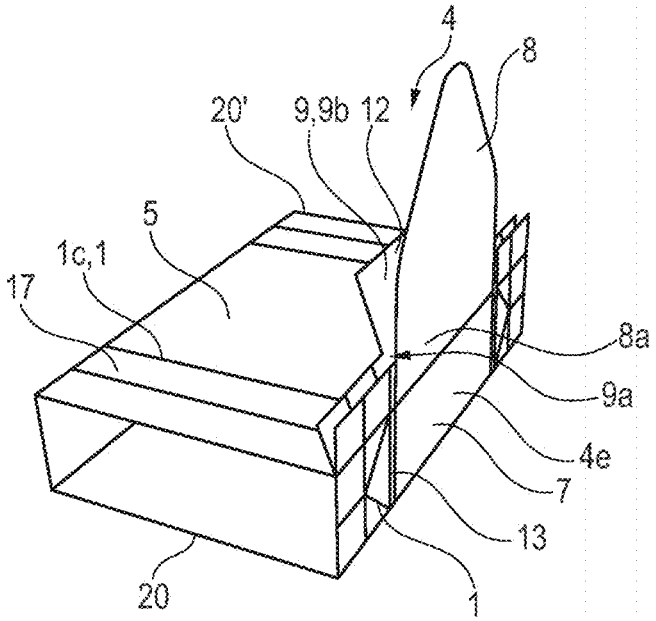
Figure 2B:
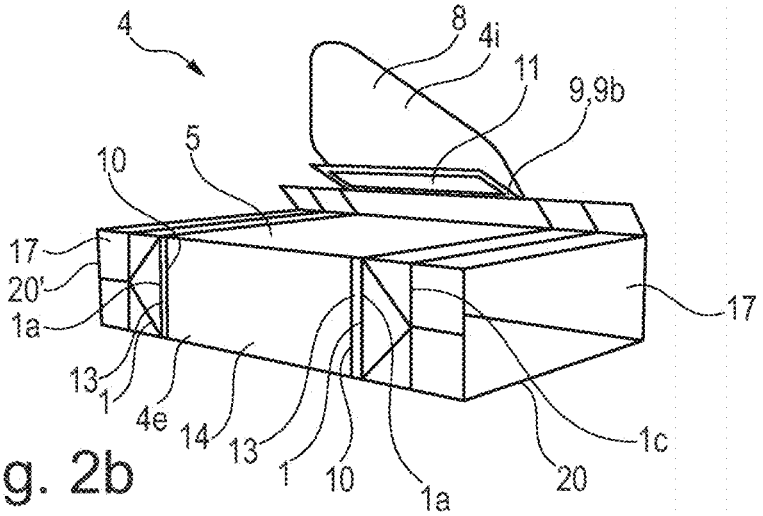
Figure 2C:
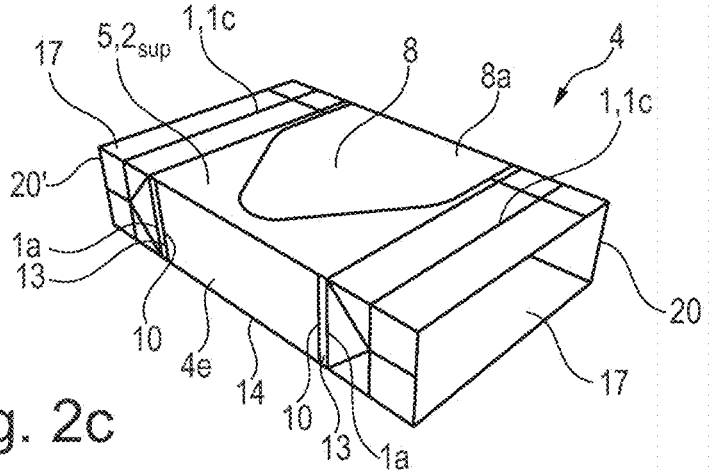
Figure 2D:
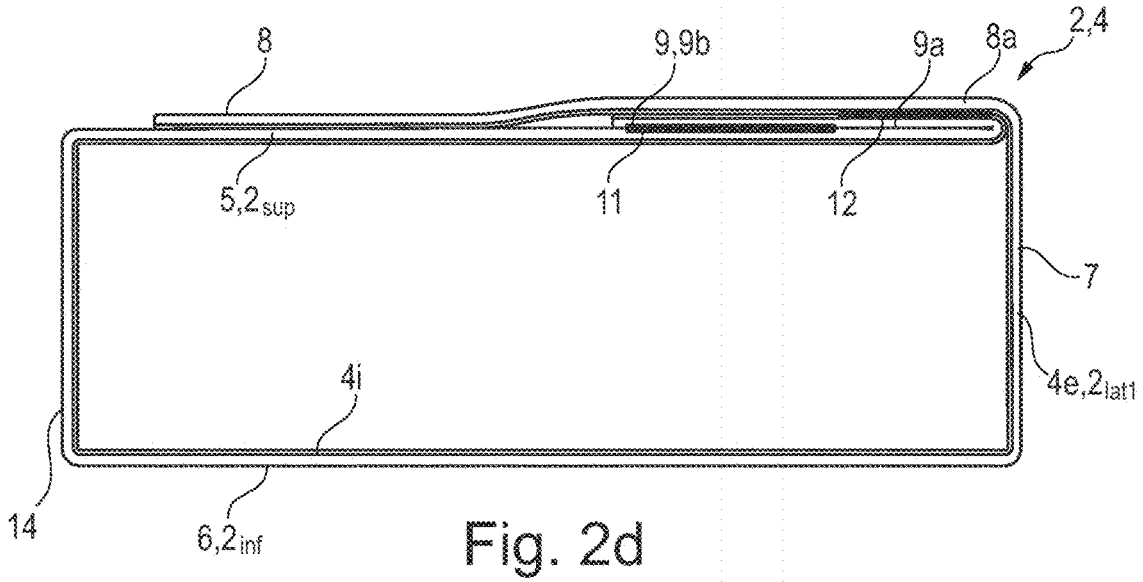
Figure 2E:
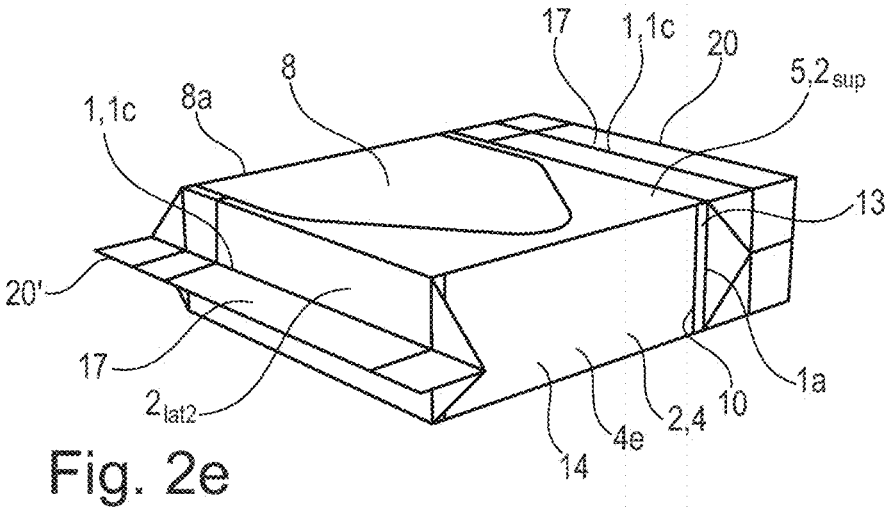
Figure 2F:
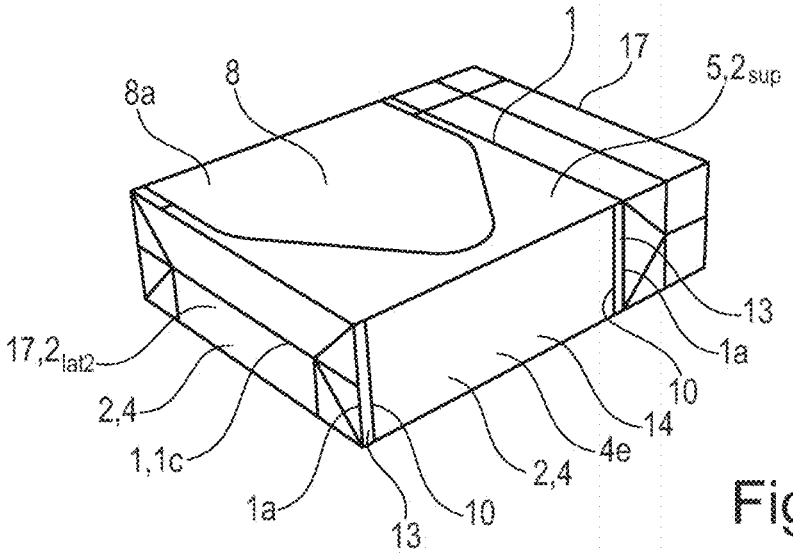
Figure 2G:
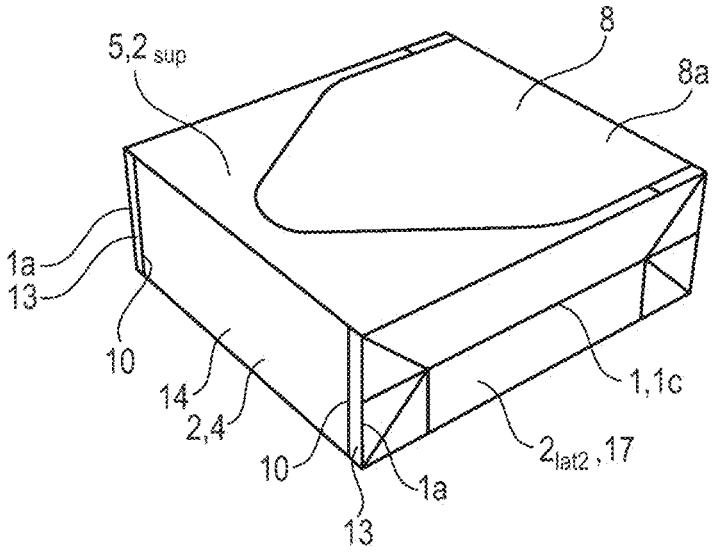

FIG. 2*g* show the blank cut of FIGS. 1*a* and 1*b* in perspective views from different orientations (FIGS. 2*a*, 2*b*, 2*c*, 2*e*, 2*f* and 2*g*) or in sagittal section (FIG. 2*d*) at different stages of its folding to form a package;

FIG. 3*a*,

FIG. 3*b*

FIG. 3*c* to

Figure 3A:
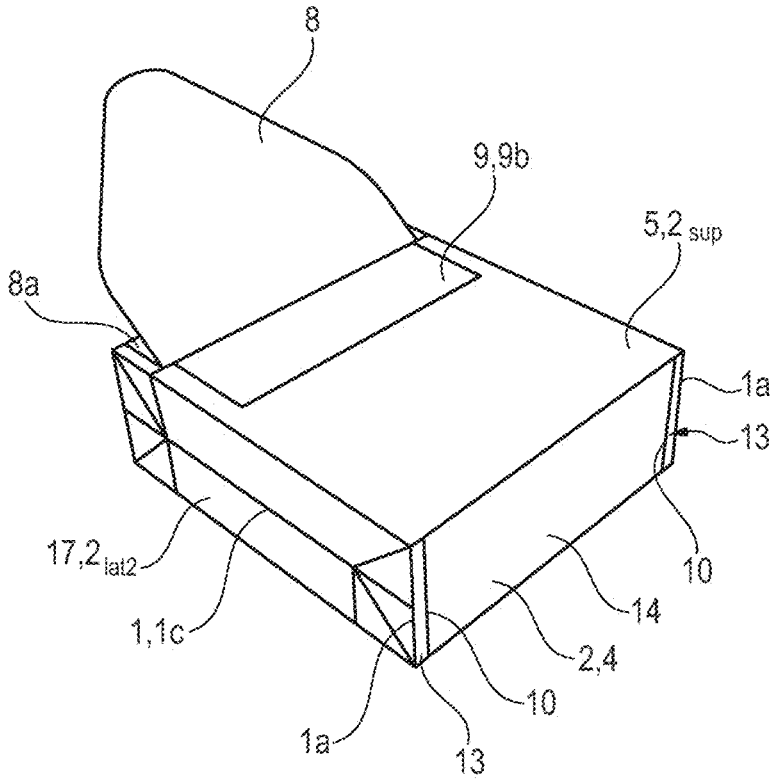
Figure 3B:
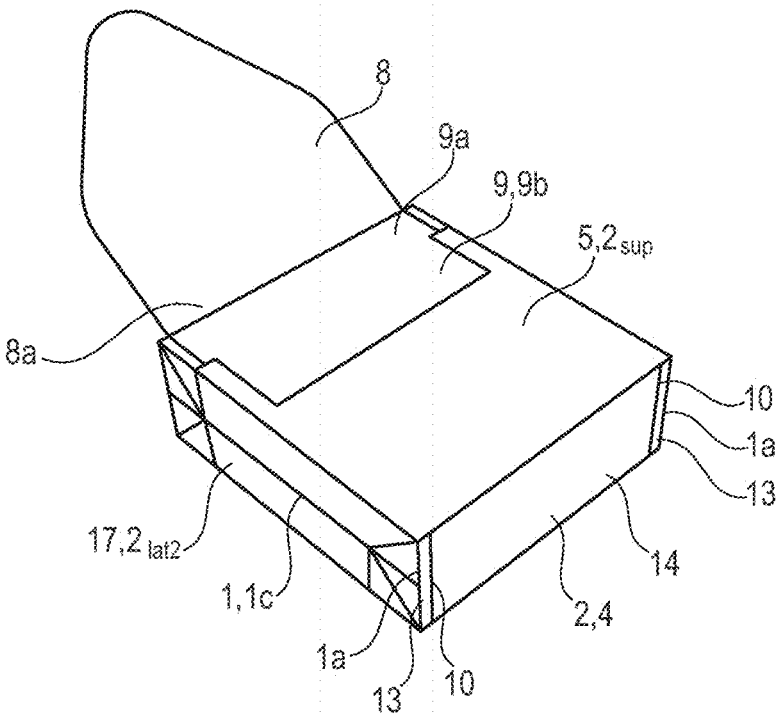
Figure 3C:
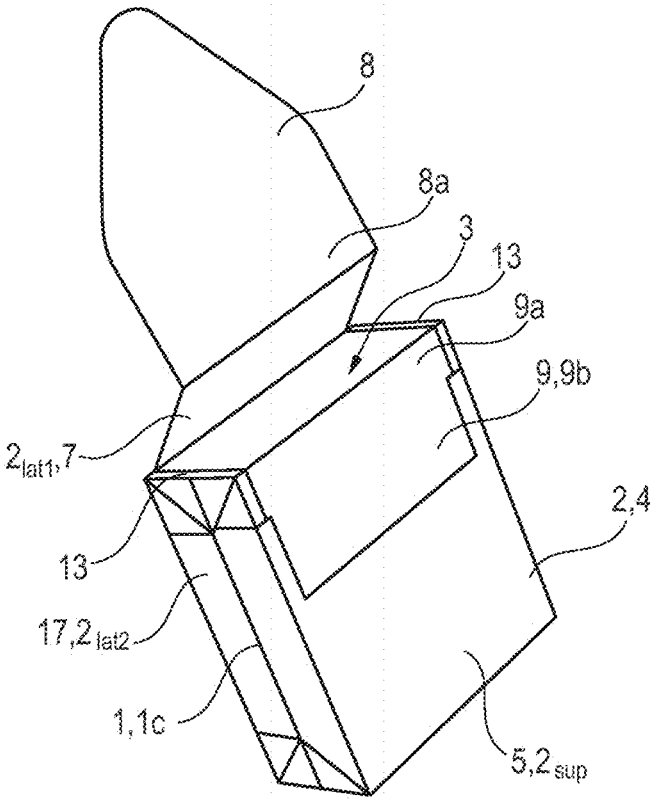
Figure 3D:
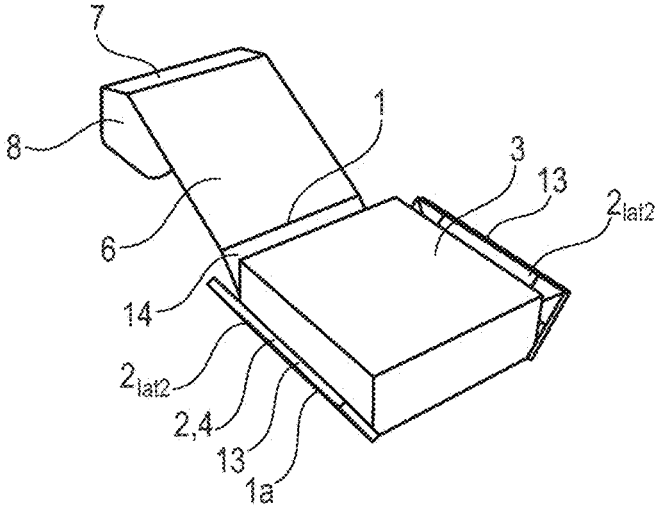

FIG. 3*d* show different opening stages of the packaging shown in FIG. 2*g* in perspective views from different orientations;

FIG. 4*a* and

Figure 4A:
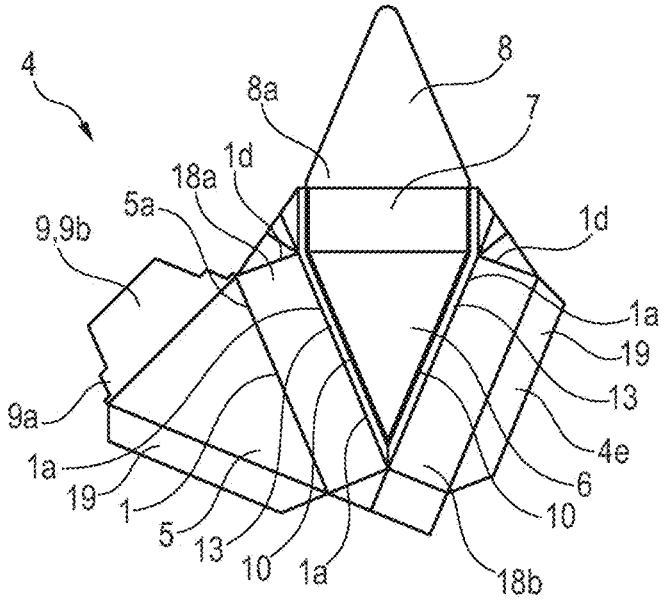
Figure 4B:
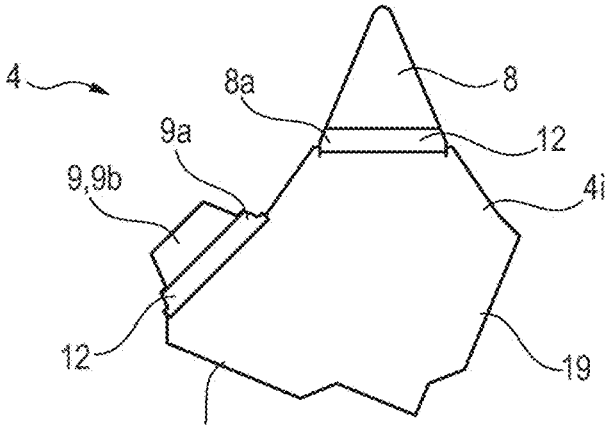

FIG. 4*b* schematically show a blank cut according to a second embodiment before its folding, seen respectively from the outside (FIG. 4*a*) and from the inside (FIG. 4*b*);

FIG. 5*a*,

FIG. 5*b*,

FIG. 5*c* to

Figure 5A:
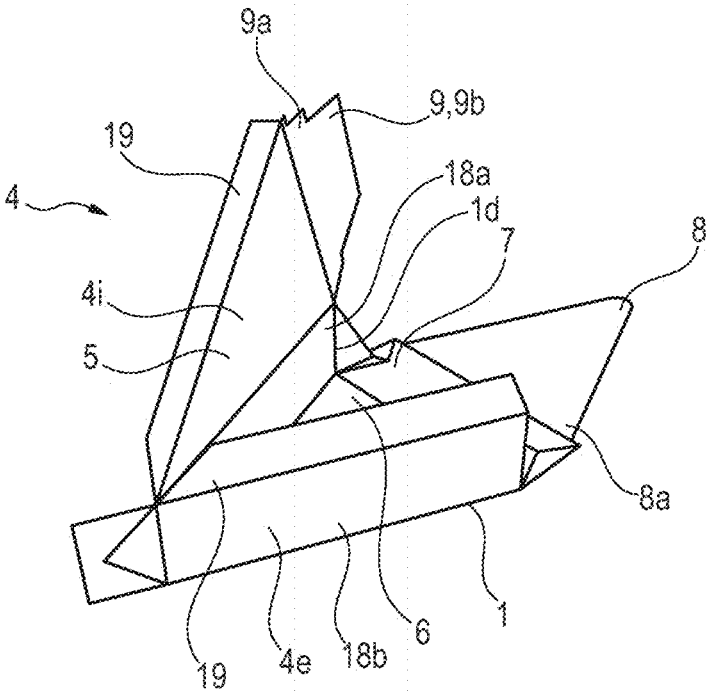
Figure 5B:
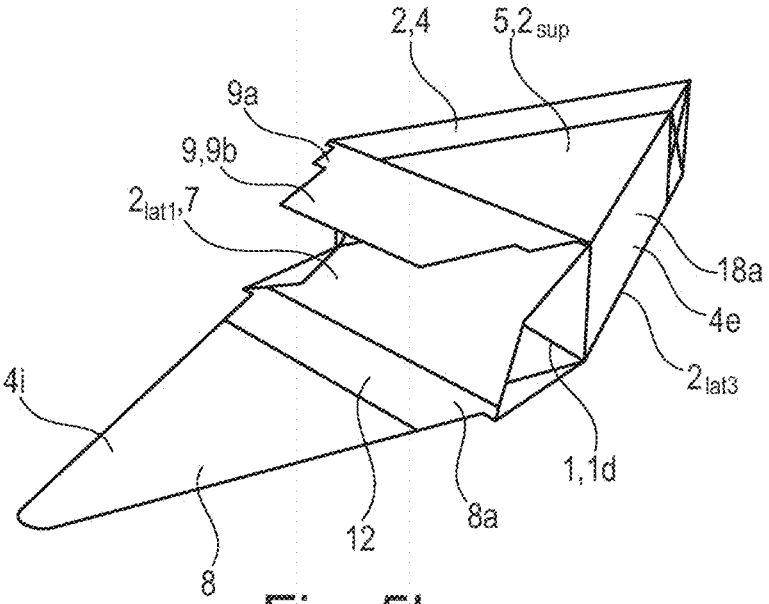
Figure 5C:
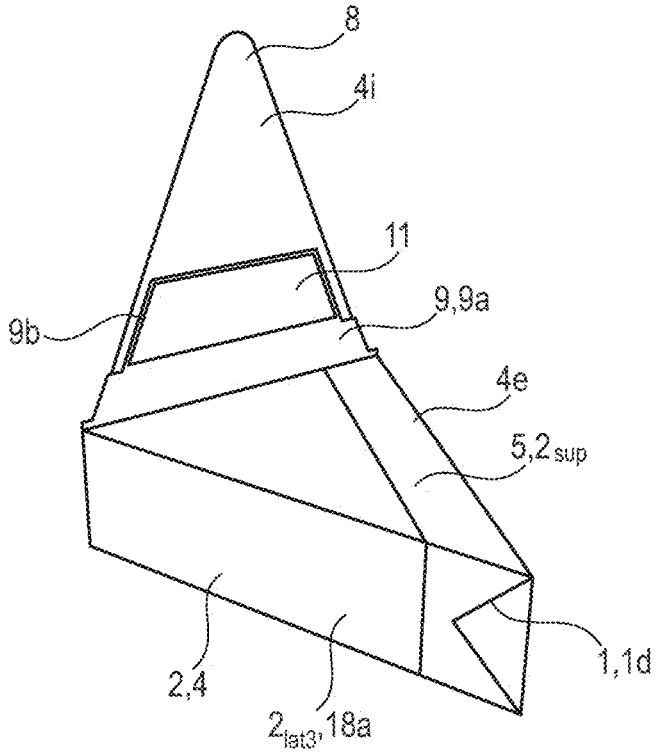
Figure 5D:
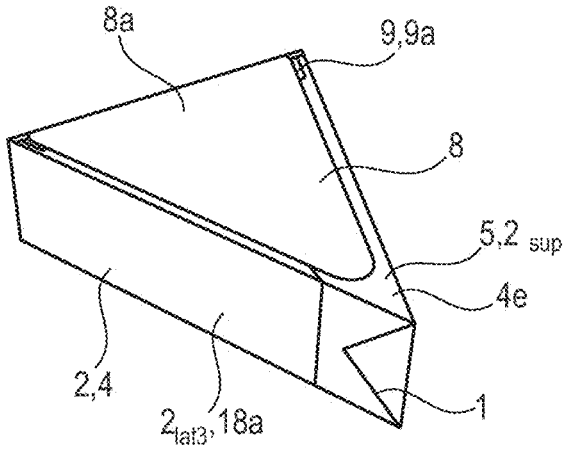

FIG. 5*d* schematically show, in perspective views from different orientations, the blank cut shown in FIGS. 4*a* and 4*b* at different stages of its folding to form a package;

FIG. 6*a*,

FIG. 6*b* to

Figure 6A:
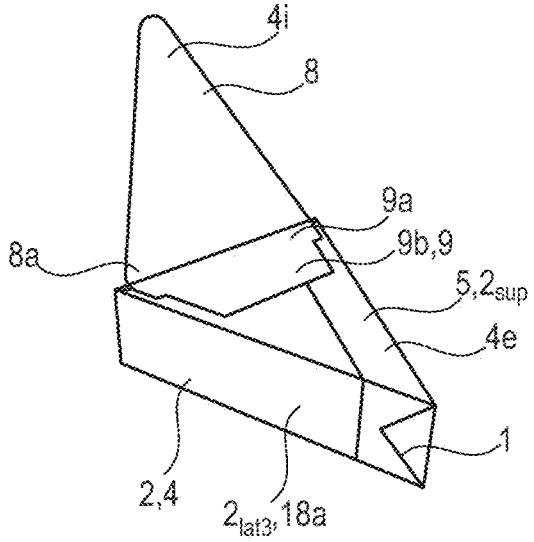
Figure 6B:
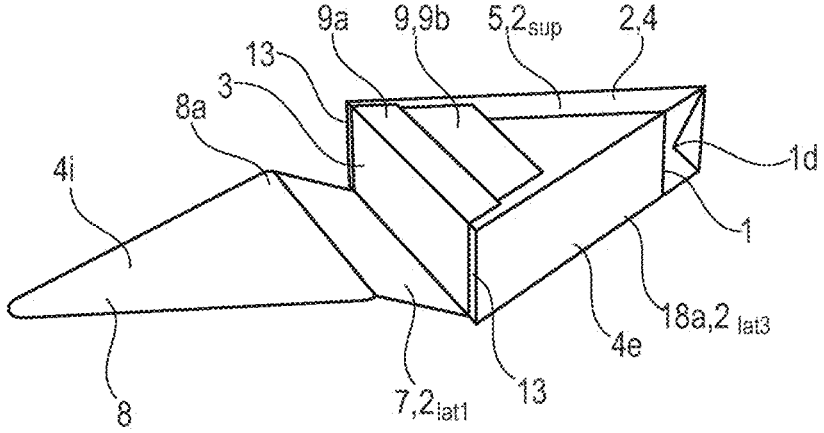
Figure 6C:
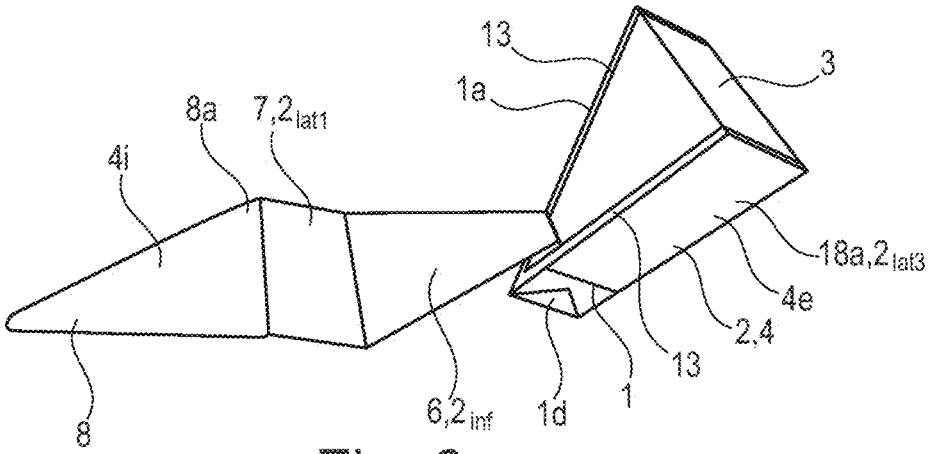

FIG. 6*c* show, in perspective from different orientations, different opening stages of the package shown in FIG. 5*d*.

In relation to these figures, a blank cut for packaging a food portion 3, in particular a single portion of fresh dairy product, for example fresh and/or melted cheese, is described below.

The blank cut is formed by a complex 4 which has a sealing layer 4*i* with oxygen and/or water vapor barrier properties, so as to guarantee the preservation of the packaged food portion 3.

The sealing layer 4*i* can be made of a food-grade plastic material, particularly when it is intended to be in contact with the food portion 3 packed in the package. For this purpose, the sealing layer 4*i* can be made from polyethylene (PE) and/or polyethylene terephthalate (PET), or from other known food-grade plastics, such as polyamide (PA), polypropylene (PP) or polylactic acid (PLA).

Advantageously, the complex 4 comprises an inner sealing layer 4*i* as described above, and an outer layer 4*e* based on cellulose fibers. In particular, the cellulose fibers may be derived from wood and shaped by paper-making process to form a layer of paper or cardboard, or they may be in the form of a non-woven fabric.

Such an arrangement makes it possible to benefit from an ecologically designed package, notably by facilitating its recycling after consumption of the food portion 3. In particular, the outer layer 4*e* can be made from recycled cellulose fibers.

According to an embodiment, the outer layer 4*e* has a mass per unit area of between 30 g/m$^2$ and 150 g/m$^2$, in particular between 50 g/m$^2$ and 110 g/m$^2$, and more particularly of the order of 80 g/m$^2$.

Advantageously, the complex 4 comprises between 60% and 90% by weight of cellulose fibers. To this end, the outer layer 4*e* can have a thickness of around 60 μm, and the inner layer 4*i* a thickness of between 4 μm and 20 μm.

To improve overall sealing properties of the package, the complex 4 can include at least one additional layer of film and/or varnish with suitable properties, particularly oxygen and/or water vapor barrier properties. In particular, the outer face of the outer layer 4*e* may be coated with an additional varnish layer with anti-condensation properties.

The complex 4 can present decorations and/or markings, for example aesthetic and/or commercial motifs and/or inscriptions linked to the food portion 3. These elements can be formed by printing and/or embossing directly on the outer layer 4*e* of cellulose fibers.

The blank cut comprises fold lines 1*a*, 1*b*, 1*c*, 1*d* enabling it to be shaped into an envelope 2 in which the food portion 3 can be packed before closing said envelope to form a package.

Advantageously, these fold lines 1*a*, 1*b*, 1*c*, 1*d* are formed by stamping the outer layer 4*e* of cellulose fibers, which facilitates the folding of the blank cut while preserving the integrity of the sealing layer 4*i*.

In relation to the figures, the fold lines 1*a*, 1*b*, 1*c*, 1*d* together define a blank cut which has:

- an upper panel 5 and a lower panel 6 intended to form respectively upper $\mathbf{2}_{sup}$ and lower $\mathbf{2}_{inf}$ walls of the envelope 2, said lower panel being extended by a first side panel 7 intended to form a first side wall $\mathbf{2}_{lat1}$ of said envelope;
- an opening tab 8 extending from said first side panel opposite to the lower panel 6, said tab having a base 8*a* designed to be associated with a closure seam 9 extending from the upper panel 5.

To facilitate opening of the package, particularly by young children and/or in relation to a soft food portion 3, the blank cut has two tear lines 10 which each extend, from an edge of the base 8*a* of the tab 8, along the first side panel 7 and the lower panel 6. In particular, the transverse distance separating the two tear lines 10 is greater than 80% of the width of the first side panel 7, in particular greater than 90%, or even equal to said width.

Thus, by exerting a pull on the tab 8, the consumer can open the package on at least two contiguous walls of the envelope 2, notably its lower wall $\mathbf{2}_{inf}$ and side wall $\mathbf{2}_{lat1}$, in order to form a large opening to allow extraction of the food portion 3 from said package.

In one embodiment, each of the tear lines 10 is obtained by partially precutting the thickness of the blank cut, in particular by ablating material, to a depth sufficient to form a line of weakness enabling the tearing of said blank cut to be guided along said line.

In order to preserve the integrity of the inner layer 4*i* and therefore the sealing of the package, the tear lines 10 are formed by at least partial ablation of only the outer layer 4*e*.

Advantageously, the tear lines 10 are formed, for example by laser or mechanical cutting, over approximately ⅘ of the total thickness of the outer layer 4*e*, which provides a good compromise between preserving the sealing of the package and facilitating its opening by tearing along said lines.

In one embodiment, the tear lines 10 allow to guide the tearing of the blank cut without prior pre-cutting of said blank cut, for example by means of a fold or groove line of the blank cut, and/or of a particular orientation of the fibers of the outer layer 4*e* along said line.

The closure seam 9 has no tear line and is arranged so as to be permanently associated on a region of the upper panel 5 which is intended to form a region of the upper wall $\mathbf{2}_{sup}$ of the envelope 2 on which said seam can be disposed, the base 8*a* of the tab 8 being arranged so as to be associated on said seam such that it can be peeled off by pulling said tab.

Thus, the package is initially opened solely by peeling the tab 8 from the seam 9 without tearing said seam, which allows to limit the effort required and thus to facilitate opening by young children and/or to limit the stresses applied to the portion 3 during said opening, said seam being held in position on the envelope 2 to make said peeling reliable.

To this end, the respective outer layers 4*e* of the seam 9 and of the region of the upper panel 5 are arranged so as to be permanently associated, with the respective inner layers 4*i* of the base 8*a* of the tab 8 and of the seam 9 arranged to be peelably associated.

According to one embodiment, at least one of the outer layers 4*e* of the seam 9 and of the region of the upper panel 5 is provided with an adhesive 11, notably based on hot melt glue or cold glue, to ensure permanent sealing of said seam to said region by their respective outer layers 4*e* ("leather-to-leather" type sealing). In the figures, only the seam 9 features such an adhesive 11 (see FIGS. 2*b*, 2*d* and 5*c*).

Similarly, at least one of the inner layers 4*i* of the base 8*a* of the tab 8 and of the seam 9 may be peelable and/or provided with a peelable varnish 12, notably based on polyethylene (PE) and/or polyester, to ensure peelable sealing of said tab on said seam by their respective inner layers 4*i* ("flesh-flesh" type sealing).

In the figures, the base 8*a* of the tab 8 and the seam 9 each have a layer of peelable varnish 12 applied to at least a part of their respective inner layer 4*i*.

As shown in particular in FIGS. 1*a*, 1*b*, 4*a* and 4*b*, the seam 9 has a base 9*a* from which a strip 9*b* extends, the bases 8*a*, 9*a* of the seam 9 and of the tab 8 being arranged to be peelably associated.

According to a first embodiment (FIGS. 1*a* to 3*d*), the tab 8 is also arranged to be partially peelably associated with the strip 9*b*.

In a second embodiment (FIGS. 4*a* to 6*c*), only the respective bases 8*a*, 9*a* of the tab 8 and the seam 9 are peelably associated.

In both embodiments shown, the upper panel 5 has no tear line, so that it remains associated with the envelope 2 after the package has been opened, thus forming a tray on which the food portion 3 can be held while waiting to be picked up by the consumer.

As shown in FIGS. 3*a* to 3*d* (first embodiment) and FIGS. 6*a* to 6*c* (second embodiment), the consumer wishing to open the package grasps the tab 8 and pulls it outwards. Thus, thanks to the permanent sealing of the seam 9 on the envelope 2, this pulling movement causes the peelable seal between the tab 8 and said seam to be released, and said tab to tear along the two portions of the tear lines 10 extending on either side of its base 8*a*.

The consumer then continues to pull on said tab to successively detach the first side panel 7 and the lower panel 6, while pivoting said package so as to direct the upper panel 5 downwards, so that the food portion 3 rests on said upper panel at the end of package opening (FIGS. 3*d* and 6*c*).

Advantageously, the lower panel 6 and the first side panel 7 are formed between two fold lines 1*a* which both extend onto the base 8*a* of the tab 8, each of the tear lines 10 extending relative to one of these fold lines 1*a*, notably parallel to the latter, while forming a band 13 between them.

In this way, once the package has been opened, each band 13 rests on an upper wall of the food portion 3, so as to hold thereon a side wall $\mathbf{2}_{lat2}$, $\mathbf{2}_{lat3}$ of the envelope 2 to which it is attached. This arrangement enables the food portion 3 to be secured laterally to the upper panel 5, while awaiting its removal by the consumer, as shown in FIG. 6*c*.

Each of the bands 13 has a width which is less than 10% of the width of the first side panel 7, and in particular less than 5% of said width. This arrangement allows to facilitate extraction of the food portion 3 by the consumer, who then simply has to move apart the side walls $\mathbf{2}_{lat2}$, $\mathbf{2}_{lat3}$ (FIG. 3*d*) to be able to remove said portion from the upper panel 5 while preserving its integrity of shape, particularly in the case of a soft food portion 3.

In the first embodiment shown (FIGS. 1*a* to 3*d*), the blank cut has upper 5, lower 6 and side 7, 14 panels, each with a quadrilateral geometry, so as to form a parallelepiped envelope 2.

In particular, the upper panel 5 and lower panel 6 are connected by a second side panel 14 of quadrilateral geometry on which the tear lines 10 extend so that the package can be opened along three sides, said blank cut presenting an axis of symmetry along its median axis.

In relation to FIGS. 1*a* and 1*b*, the blank cut has:

- a first transverse end edge 15, formed on the first side panel 7, from which the opening tab 8 extends; and
- a second transverse end edge 16, formed on the upper panel 5 and longitudinally opposite said first edge, and on which the seam 9 is formed.

In particular, the tab 8 and the strip 9*b* of the seam 9 each extend longitudinally projecting from a respective edge 15, 16, and the blank cut has two transverse fold lines 1*b* each extending adjacent and parallel to a respective end edge 15, 16, so as to define the base 8*a*, 9*a* of said tab or of said seam, and to enable folding of said base relative to the adjacent panel 7, 5 during formation of the envelope 2.

The blank cut also comprises two longitudinal borders 17 extending on either side of the upper panel 5 and lower panel 6, and each equipped with a plurality of fold lines 1*a*, 1*c* for forming side walls $\mathbf{2}_{lat2}$ of the envelope 2.

In FIGS. 1*a* and 1*b*, the borders 17 each extend from one end edge 15 to the opposite end edge 16.

In addition, each border 17 is separated from the lower panel 6 and the side panels 7, 14 by a longitudinal fold line 1*a*, opposite which a tear line 10 extends parallel.

Thus, the bands 13 are each adjacent to a respective border 17, the latter forming the side walls $\mathbf{2}_{lat2}$ designed to hold the food portion 3 on the upper panel 5 at the end of the package opening.

In the second embodiment shown (FIGS. 4*a* to 6*c*), the lower panel 6 has a triangular geometry, while the first side panel 7 has a quadrilateral geometry.

In addition, the lower panel 6 is extended respectively by the first side panel 7 and two borders 18*a*, 18*b* of quadrilateral geometry, the upper panel 5 having a triangular geometry, one side 5*a* of which is connected to the lower panel 6 by a first 18*a* of said borders, said borders being equipped with fold lines 1*a*, 1*d* enabling the formation of side walls $\mathbf{2}_{lat3}$ of a prismatic envelope 2 with a triangular base.

In particular, each border 18*a*, 18*b* is separated from the lower panel 6 and from the side panel 7 by a longitudinal fold line 1*a* opposite which a tear line 10 extends parallel, the bands 13 thus being adjacent to a respective border 18*a*, 18*b* to enable the latter to form the side walls $\mathbf{2}_{lat3}$ which will hold the food portion 3 on the upper panel 5 after the package has been opened.

The second border 18*b* and the upper panel 5 are each equipped with an associating flap 19, said flaps being intended to be permanently associated on their respective outer layers 4*e* ("leather-to-leather" sealing), notably by means of a heat-seal adhesive or cold glue.

In particular, in this second embodiment, the tear lines 10 can be arranged to ensure total detachment of the tab 8—side panel 7—lower panel 6 assembly from the package after opening.

In relation to FIGS. 2*a* to 2*d* (first embodiment) and FIGS. 5*a* to 5*d* (second embodiment), a method for packaging a food portion 3 using a blank cut as described above is now described.

This method provides to fold the blank cut along its fold lines 1*a*, 1*b*, 1*c*, 1*d*, so as to form an open envelope 2 in which the food portion 3 is packaged before closing said envelope, as well as to permanently associate the seam 9 on the upper wall $\mathbf{2}_{sup}$ of the envelope 2 and to peelably associate the base 8*a* of the tab 8 on said seam.

Advantageously, the method provides to fold the blank cut so as to leave a single opening in the envelope 2 (FIGS. 2*f* and 5*b*), in order to form by means of said envelope a mold into which the food portion 3 can be poured in liquid or viscous form before closing said envelope, thereby limiting production costs by avoiding an additional step of shaping said food portion prior to packaging in the package.

This arrangement also allows to produce packaged food portions 3 in a more hygienic way and with better preservation conditions. Indeed, by pouring the food portion 3 directly into its individual packaging, its exposure to ambient air is limited, thus reducing the risk of contamination, particularly by germs. Moreover, if the food portion 3 is poured at a temperature higher than the pasteurization temperature, its preservation properties are further improved.

In the first embodiment (FIGS. 2*a* to 2*d*), the associations of the seam 9 on the upper wall $\mathbf{2}_{sup}$ of the envelope 2 and of the base 8*a* of the tab 8 on said seam are carried out prior to packaging the food portion 3, the subsequent closure of said envelope being carried out by folding and associating a border 17 of the blank cut.

In particular, this first embodiment firstly provides to associate the seam 9 to the envelope 2 and to the tab 8, at first by performing the "flesh-to-flesh" peelable association of the base 8*a* of the tab 8 on said seam (FIGS. 2*a*, 2*b*), and then by performing the "leather-to-leather" permanent association of said seam on the upper wall $\mathbf{2}_{sup}$ of said envelope (FIG. 2*c*).

Next, the method provides to fold a first longitudinal border 17 so as to close one side of the package, leaving the opposite side open for the introduction of the food portion 3, particularly in liquid or viscous form (FIGS. 2*e*, 2*f*).

Finally, the method provides to fold the second longitudinal border 17 to close the package completely (FIG. 2*g*).

According to a variant of this first embodiment, the method may provide to form simultaneously several blank cuts in a single sheet of the complex 4, then to separate said blank cuts from one another once they have been filled with a food portion 3.

To achieve this, the method may provide to form, in a rectangular sheet of the complex 4, several-blank cuts as shown in FIGS. 1*a* and 1*b* by pre-cutting and stamping, so that a free longitudinal edge 20 of a border 17 of a first blank cut merges with the free longitudinal edge 20' of the opposite border 17 of an adjacent second blank cut.

In the second embodiment (FIGS. 5*a* to 5*d*), the method provides to perform closure of the envelope 2 by associating the tab 8 on the seam 9.

In particular, the envelope 2 is formed by first folding the borders 18*a*, 18*b* with respect to the lower panel 6, along their respective lines 1*a*, then by folding the upper panel 5 along its side 5*a* adjacent to the second border 18*b*, so as to fold it towards the first border 18*a* and to associate it with said first border by permanent gluing of their flaps 19 (FIG. 5*a*).

At the end of these steps, an envelope 2 is obtained in which an opening remains (FIG. 5*b*), through which the food portion 3 can be introduced, particularly in liquid or viscous form as described previously.

Then, to close the envelope 2, this second embodiment, like the first embodiment described above, to firstly perform the "flesh-to-flesh" peelable association of the tab 8 on the seam 9 (FIG. 5*c*), then to perform the "leather-to-leather" permanent association of the seam 9 on the upper wall $\mathbf{2}_{sup}$ of the envelope 2 (FIG. 5*d*).

The invention claimed is:

1. Blank cut for packaging a food portion (3) comprising fold lines (1*a*, 1*b*, 1*c*, 1*d*) for shaping said blank cut into an envelope (2) in which said portion can be packaged before closing said envelope, said fold lines defining a blank cut having:

an upper panel (5) and a lower panel (6) intended to form respectively upper ($\mathbf{2}_{sup}$) and lower ($\mathbf{2}_{inf}$) walls of said envelope, said lower panel being extended by a first side panel (7) intended to form a first side wall ($\mathbf{2}_{lat1}$) of said envelope;

an opening tab (8) extending from said first side panel opposite to the lower panel (6), said tab having a base (8*a*) designed to be coupled to a closure seam (9) extending from the upper panel (5);

wherein said blank cut further presenting two tear lines (10) which each extend, from an edge of the base (8*a*) of the tab (8), along the first side panel (7) and the lower panel (6), said blank cut being characterized in that the seam (9) has no tear line, wherein one of said fold lines is defined between said seam and said upper panel (5) such that said seam being arranged to fold over an area region of said upper panel and to be permanently coupled to said area region by a permanent adhesive, and wherein the base (8*a*) of the tab (8) being arranged so as to be coupled to said seam such that it can be peeled off by pulling the opening tab (8).

2. Blank cut according to claim 1, characterized in that it is formed by a complex (4) comprising outer layers (4*e*) based on cellulose fibers and inner sealing layers (4*i*).

3. Blank cut according to claim 2, characterized in that the outer layers (4*e*) of the seam (9) and of the region of the upper panel (5) are arranged to be permanently associated, the inner layers (4*i*) of the base (8*a*) of the tab (8) and of the seam (9) being arranged to be peelably associated.

4. Blank cut according to claim 3, characterized in that at least one of the outer layers (4*e*) of the seam (9) and of the region of the upper panel (5) is provided with an adhesive (11).

5. Blank cut according to claim 3, characterized in that at least one of the inner layers (4*i*) of the base (8*a*) of the tab (8) and of the seam (9) is peelable and/or is provided with a peelable varnish (12).

6. Blank cut according to claim 2, characterized in that the tear lines (10) are formed by at least partial ablation of only the outer layer (4*e*).

7. Blank cut according to claim 1, characterized in that the upper panel (5) has no tear line.

8. Blank cut according to claim 1, characterized in that the lower panel (6) and the first side panel (7) are formed between two fold lines (1*a*), said lines extending onto the base (8*a*) of the tab (8), each of the tear lines (10) extending relative to a fold line (1*a*) while forming a band (13) between them.

9. Blank cut according to claim 8, characterized in that each of the bands (13) has a width which is less than 10% of the width of the first side panel (7), in particular less than 5%.

10. Blank cut according to claim 1, characterized in that the seam (9) has a base (9*a*) from which a strip (9*b*) extends, the bases (8*a*, 9*a*) of the seam (9) and of the tab (8) being arranged to be peelably associated.

11. Blank cut according to claim 1, characterized in that the upper (5) and lower (6) panels are connected by a second side panel (14), the tear lines (10) extending onto said second side panel.

12. Blank cut according to claim 1, characterized in that it comprises two longitudinal borders (17) extending on either side of the upper (5) and lower (6) panels, said borders being equipped with fold lines (1*a*, 1*c*) for forming side walls ($\mathbf{2}_{lat2}$) of the envelope (2).

13. Blank cut according to claim 1, characterized in that it has upper (5), lower (6) and side (7, 14) panels, each with a quadrilateral geometry enabling to form a parallelepiped envelope (2).

14. Blank cut according to claim 1, characterized in that the lower panel (6) has a triangular geometry, the first side panel (7) having a quadrilateral geometry, each of the sides of the lower panel (6) being extended by respectively the first side panel (7) and two borders (18*a*, 18*b*), the upper panel (5) having a triangular geometry, one side (5*a*) of which is connected to the lower panel (6) by a first (18*a*) of said borders, said borders being equipped with fold lines (1*a*, 1*d*) enabling to form side walls ($\mathbf{2}_{lat3}$) of a prismatic envelope (2) with a triangular base.

15. A method for packaging a food portion (3) by means of a blank cut according to claim 1, in which said blank cut is folded along its fold lines to form an open envelope (2) in which said portion is packaged prior to closure of said envelope, said method providing for permanently associating the seam (9) on the upper wall ($\mathbf{2}_{sup}$) of the envelope (2) and peelably associating the base (8*a*) of the tab (8) on said seam.

16. Blank cut for packaging a food portion (3) comprising fold lines (1*a*, 1*b*, 1*c*, 1*d*) for shaping said blank cut into an envelope (2) in which said portion can be packaged before closing said envelope, said fold lines defining a blank cut having:

an upper panel (5) and a lower panel (6) intended to form respectively upper ($\mathbf{2}_{sup}$) and lower ($\mathbf{2}_{inf}$) walls of said envelope, said lower panel being extended by a first side panel (7) intended to form a first side wall of said envelope, and a second side panel (14) intended to form a second side wall of said envelope;

an opening tab (8) extending from said first side panel opposite to the lower panel (6), said tab having a base (8*a*) designed to be coupled to a closure seam (9) extending from the upper panel (5);

wherein said upper (5), lower (6) and first and second side panels (7, 14) each include a quadrilateral geometry enabling to form a parallelepiped envelope (2);

wherein said blank cut further presenting two tear lines (10) which each extend, from an edge of the base (8*a*) of the tab (8), along the first side panel (7) and the lower panel (6), said blank cut being characterized in that the seam (9) has no tear line, wherein said seam being arranged so as to be permanently coupled to said area region of the upper panel (5), and wherein the base (8*a*) of the tab (8) being arranged so as to be coupled to said seam such that it can be peeled off by pulling the opening tab (8).

* * * * *